United States Patent [19]

Auer

[11] Patent Number: 4,875,147

[45] Date of Patent: Oct. 17, 1989

[54] DELAYED ACTION FLASHLIGHT

[75] Inventor: Robert T. Auer, East Stroudsburg, Pa.

[73] Assignee: Buddy L. Corporation, New York, N.Y.

[21] Appl. No.: 325,947

[22] Filed: Mar. 20, 1989

[51] Int. Cl.[4] ..... F21L 7/00; F21L 11/00

[52] U.S. Cl. ..... 362/205; 362/157; 362/202

[58] Field of Search ..... 362/202, 204, 205, 206, 362/157, 196

[56] References Cited

U.S. PATENT DOCUMENTS

| | | | |
|---|---|---|---|
| 2,810,797 | 10/1957 | Gulnick | 200/33 R |
| 3,646,302 | 2/1972 | Lehmann | 200/33 R |
| 4,237,526 | 12/1980 | Wood | 362/202 |

*Primary Examiner*—Carroll B. Dority
*Attorney, Agent, or Firm*—Michael Ebert

[57] ABSTRACT

A flashlight having a delayed action switch assembly which functions to connect a light bulb to a battery supply. Included in the assembly is a pivoted trigger lever mounted on the underside of the flashlight handle. The lever is biased by a leaf spring forming the first contact of a leaf spring switch having a second contact and an intermediate contact interposed between the first and second contacts, the contacts being normally disengaged from each other. The switch is closed only when the first and second contacts engage the intermediate contact. Also included in the flashlight is a slide actuator on the upper side of the handle which cooperates with the second contact, such that when the actuator is in its forward "on" position, the second contact is deflected to engage the intermediate contact, and when in its rear "off" position, the second contact is disengaged. When the trigger lever is momentarily depressed by an operator grasping the handle, it acts to deflect the first contact to engage the intermediate contact. When so depressed, the lever engages, compresses and collapses a stationary suction cup to retain the lever in its depressed state, whereby if the actuator is then in its "on" position, the flashlight is turned "on." The memory characteristics of the cup are such as to retain the lever in its depressed state for a predetermined interval. At the conclusion of this interval, the cup resumes its normal form and the lever is released to open the switch.

9 Claims, 3 Drawing Sheets

Fig. 1.
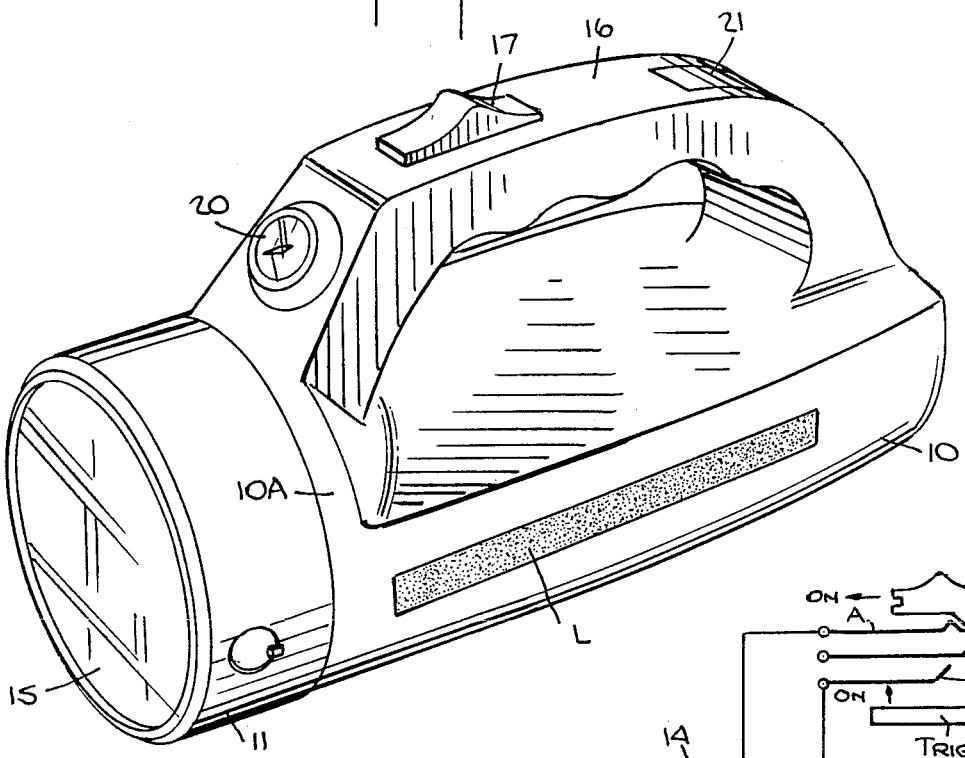
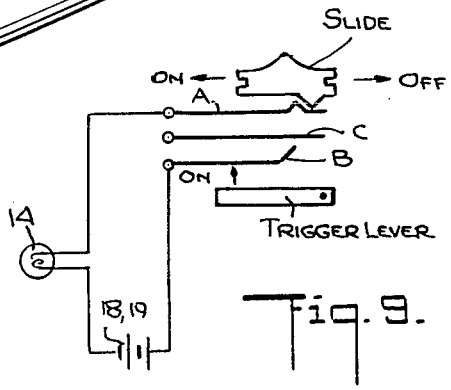
Fig. 9.
Fig. 3.
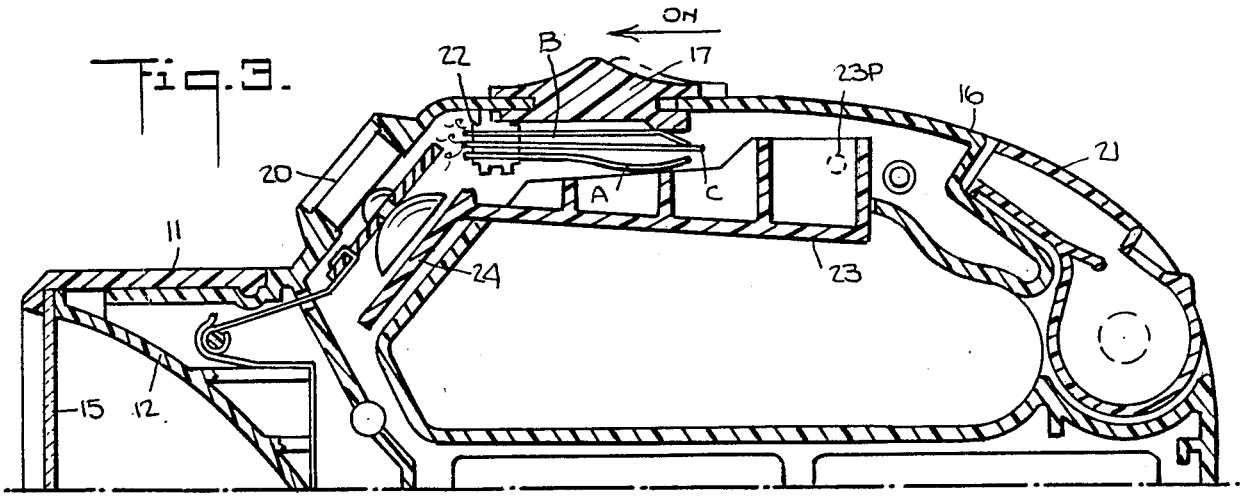

Fig. 4.
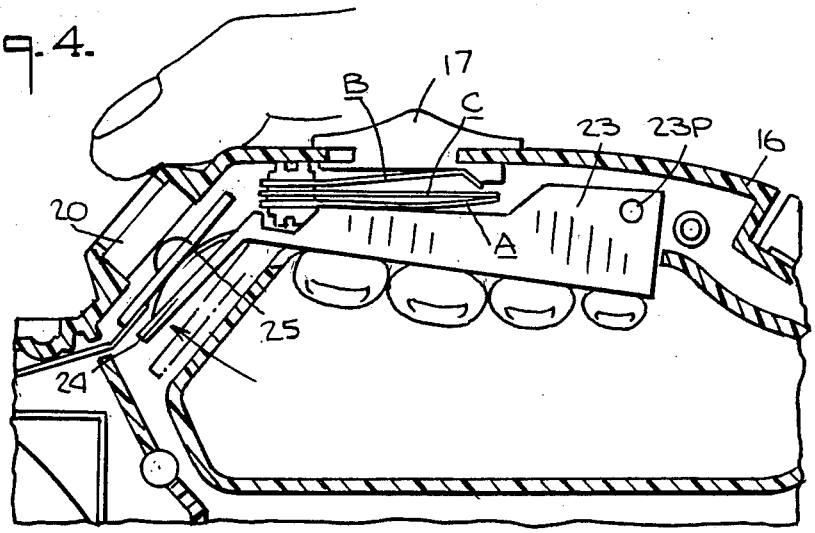
Fig. 5.
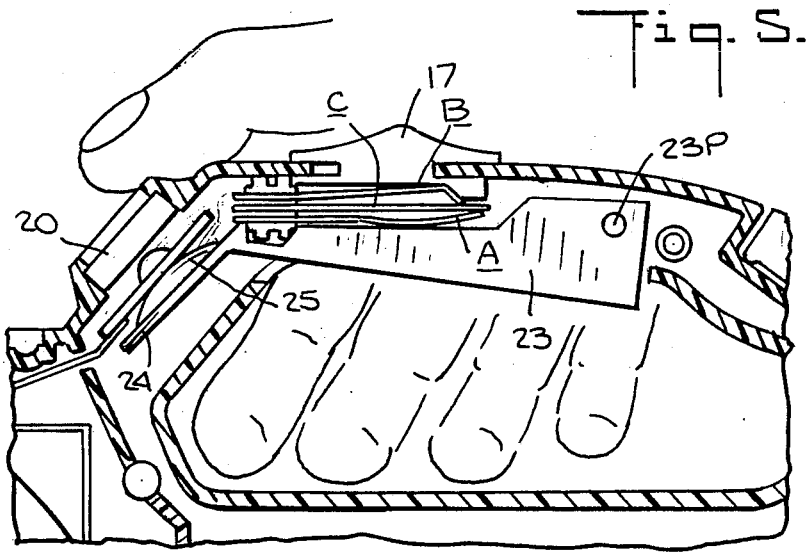
Fig. 7.
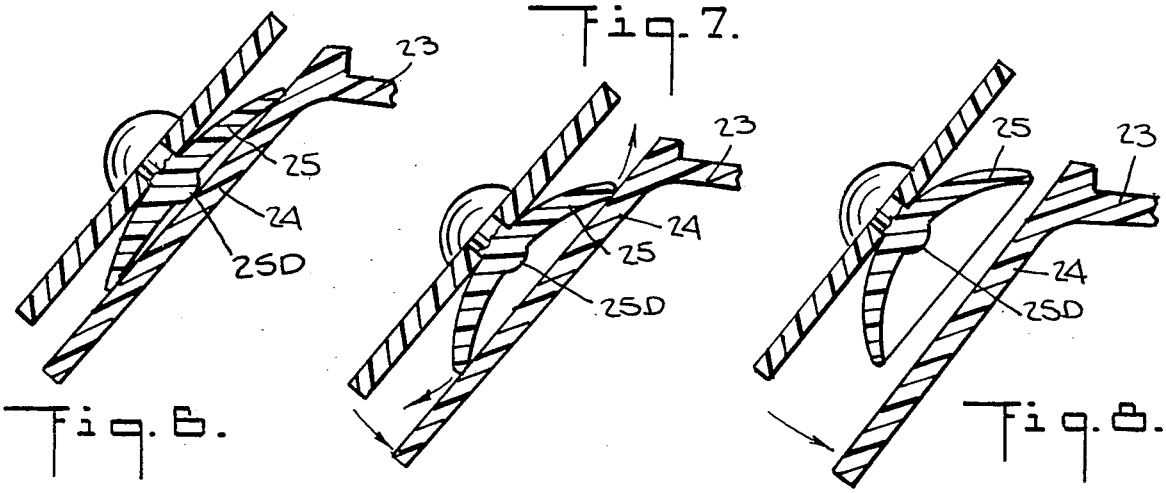
Fig. 6.
Fig. 8.

DELAYED ACTION FLASHLIGHT

BACKGROUND OF INVENTION

1. Field of Invention

This invention relates generally to flashlights, and more particularly to a flashlight provided with a switch assembly that when momentarily actuated by an operator functions to connect a light bulb to a battery power supply to turn the flashlight "on" for a predetermined interval, at the conclusion of which the flashlight is automatically turned "off."

2. Status of Prior Art

In a conventional flashlight, a manually-operated switch functions to turn the flashlight "on" and "off." When turned "on," battery power is applied through the closed switch to a light bulb, the amount of power then consumed depending on how long the switch is closed.

In the typical flashlight, the effective life of the batteries is only a few hours at most. Should the operator, after using the flashlight to find his way in the dark or for any other purpose, then fail or forget to turn it off, the batteries will in a fairly short time become exhausted. And should the flashlight be left in the turned-on and exhausted condition for a prolonged period, the batteries may then leak and exude a corrosive electrolyte that is damaging to the contacts which engage the battery terminals as well as the casing of the flashlight.

When a flashlight is designed for use by a young child, the likelihood is greater that the flashlight will be mishandled, for a young child is prone to be careless and to forget to turn the flashlight "off" after it has served its purpose. Because of this, a flashlight may be left "on" for days, if not weeks, and as a result of internal corrosion may no longer be in working order when the exhausted batteries are replaced.

Flashlights designed for young children are sometimes in a lantern format, with a casing made of strong plastic material that is virtually unbreakable, the light bulb being mounted within a reflector at the front end of the casing and being covered by a lens from which a light beam is projected. A U-shaped handle is attached to the upper end of the casing, with an on-off slide switch being mounted on the handle, so that a child grasping the handle can readily manipulate the slide actuator with his thumb.

With a switch of this type on top of a flashlight handle, when the slide actuator is pushed forward by the thumb, the flashlight is turned "on" and remains "on" until the slide actuator is pulled back to the "off" position. It is this type of switch in the hands of a child that is most likely to be inadvertently left "on."

To avoid this problem, many flashlights include, in addition to a slide switch, a push button switch which keeps the flashlight turned on only when finger pressure is applied to the push button. It is difficult for a young child who wishes, say, to illuminate a dark corner in the basement of his home for about 30 seconds, to keep a push button depressed for this period. He is therefore more likely to actuate the slide switch to its permanently-on position, for this requires only a momentary finger motion.

A flashlight is essential equipment in children's summer camps. But should the child go on a night hike with fellow campers, he requires not only a flashlight but also a compass to find his way, and a whistle should the child become lost and wish to attract attention. A child is not likely to misplace a flashlight which is relatively bulky. However, this is not true of a small whistle and a compass; hence a need exists to integrate a flashlight with a whistle and compass to avoid the loss of the smaller items.

It is known to provide a flashlight with a delayed action switch which automatically turns off after a predetermined interval. Thus, the Mallory Pat. No. 3,535,282 discloses a flashlight that is automatically turned off by a delayed action switch assembly that includes a compression spring housed in a bellows having a leaky valve, so that when a switch is turned on manually, this action serves to compress the bellows which after a predetermined interval acts to turn off the switch.

A similar delayed action is obtained in a flashlight for children marketed by the Playskool Company, this delayed action being realized by means of a resistance-capacitance timing network which applies a bias to a solid-state transistor switch after 30 seconds or so to cut off the transistor and shut off the flashlight.

In the field of telephones, it is known to obtain a delayed switching action by means of a suction cup. This is disclosed in the Gulnick Pat. No. 2,810,797. In Lehman Pat. No. 3,646,302, a delayed switching action by means of a suction cup is effected in a lamp cord switch.

SUMMARY OF INVENTION

In view of the foregoing, the main object of this invention is to provide a switch assembly for a flashlight which includes a suction cup as a delayed action element whereby the flashlight, when momentarily actuated by an operator, functions to connect a battery power supply to a light bulb, and which maintains this connection for a predetermined interval determined by the memory characteristics of the suction cup, after which the connection is automatically broken.

A significant advantage of the invention is that regardless of how the flashlight is operated by a user, once the user ceases to operate the flashlight, it will automatically turn "off" after a relatively short interval.

Also an object of the invention is to provide a flashlight of the above type which further includes a slide actuator which cooperates with one contact of the assembly switch so that the operator can, when the flashlight is turned "on" for a predetermined interval, then repeatedly switch the flashlight "off" and "on" to effect light signalling.

A further object of the invention is to provide a flashlight which also incorporates a compass and a whistle, as well as a secret compartment.

Yet another object of the invention is to provide a flashlight with reflective or phosphorescent strips for night safety.

Briefly stated, these objects are attained in a flashlight having a delayed action switch assembly which functions to connect a light bulb to a battery supply. Included in the assembly is a pivoted trigger lever mounted on the underside of the flashlight handle. The lever is biased by a leaf spring forming the first contact of a leaf spring switch having a second contact and an intermediate contact interposed between the first and second contacts, the contacts being normally disengaged from each other. The switch is closed only when the first and second contacts engage the intermediate contact.

Also included in the flashlight is a slide actuator on the upper side of the handle which cooperates with the second contact, such that when the actuator is in its forward "on" position, the second contact is deflected to engage the intermediate contact, and when in its rear "off" position, the second contact is disengaged. When the trigger lever is momentarily depressed by an operator grasping the handle, it acts to deflect the first contact to engage the intermediate contact. When so depressed, the lever engages, compresses and collapses a stationary suction cup to retain the lever in its depressed state, whereby if the actuator is then in its "on" position, the flashlight is turned "on." The memory characteristics of the cup are such as to retain the lever in its depressed state for a predetermined interval.

At the conclusion of this interval, the cup resumes its normal form and the lever is released to open the switch. Hence to turn the flashlight "on," the actuator must be in its "on" position and the lever must at the same time be in its depressed state. In this condition, the operator, by sliding the actuator repeatedly back and forth, can cause the light to turn "on" and "off" intermittently and thereby produce a signalling light.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a flashlight provided with a delayed action switch assembly in accordance with the invention, the flashlight also including a slide actuator for light signalling;

FIG. 3 is the same sectional view as in FIG. 2., but with the slide actuator in its "on" position;

FIG. 4 shows an operator grasping the handle of the flashlight, and in doing so, momentarily depressing the trigger lever of the delayed action switch assembly;

FIG. 5 shows the operator still grasping the handle, but with his fingers now disengaged from the trigger lever;

FIG. 6 illustrates the first phase of trigger lever operation in which the lever acts to compress and collapse a suction cup, and in doing so, to be retained in its depressed state by the suction cup;

FIG. 7 is the second and later phase of trigger lever operation in which the suction cup is in the process of resuming its normal form;

FIG. 8 is the last phase of trigger lever operation in which the lever is disengaged from the suction cup; and FIG. 9 is a schematic diagram of the flashlight electrical circuit.

DESCRIPTION OF INVENTION

Figure 2:
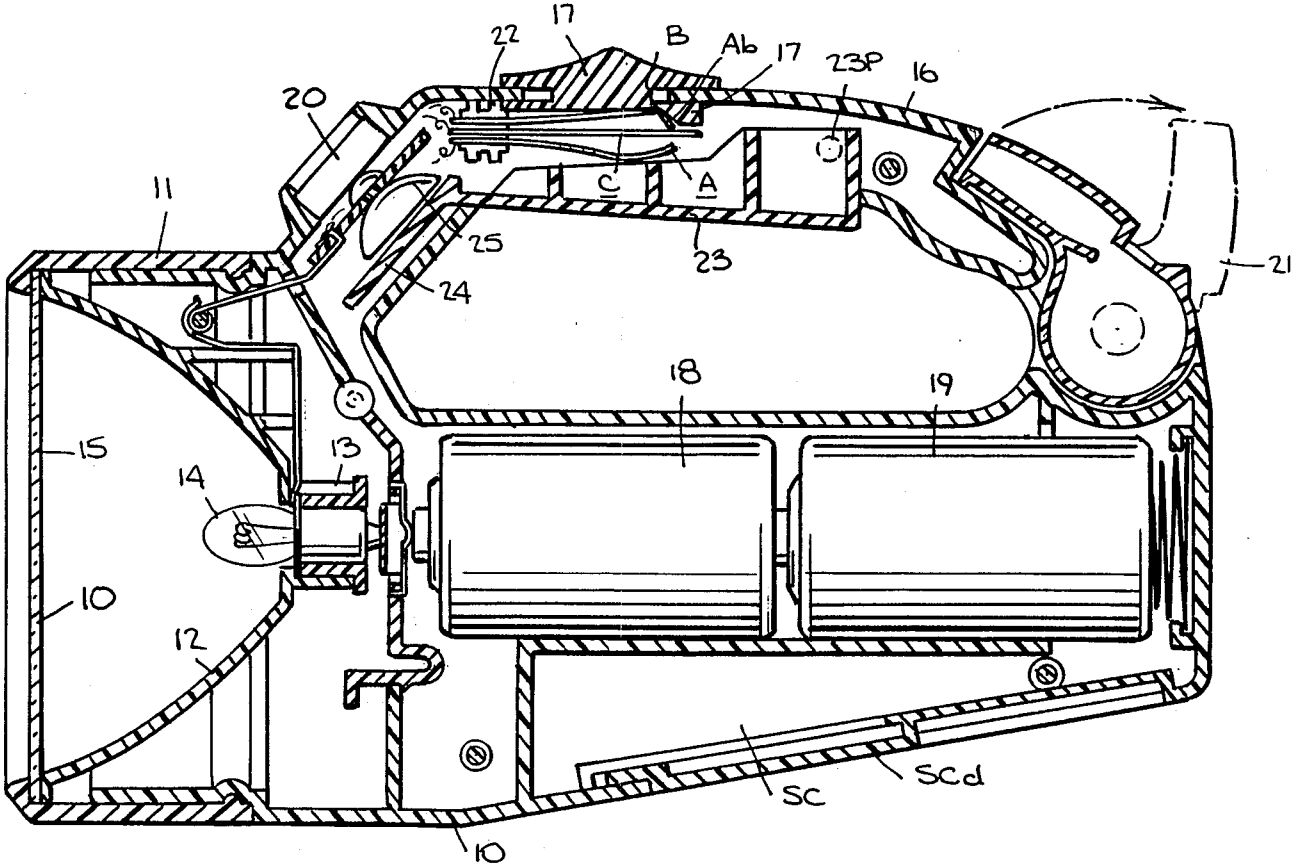
FIG. 2 is a longitudinal section taken through the flashlight, showing the slide actuator in its "off" position.

Referring now to FIGS. 1, 2 and 3, there is shown a flashlight that incorporates a delayed action switch assembly in accordance with the invention, which when momentarily actuated connects a light bulb to a battery supply for a predetermined interval to turn the flashlight "on," at the conclusion of which interval the flashlight automatically turns "off."

The flashlight, which is in a lantern format, includes a casing 10 molded or otherwise fabricated of synthetic plastic material, such as rigid polyvinyl chloride or polystyrene of good mechanical strength. At the cylindrical front end 10A of the casing is a detachable collar 11 supporting a concave reflector 12 at whose center is a socket 13 in which is received a flashlight bulb 14. The reflector is covered by a lens 15 whereby when the bulb is energized, a beam of light is projected through the lens.

While in the figures a detent arrangement is shown to retain the collar on the front end 10A of the casing, in practice, front end 10A may be provided with a pair of diametrically opposed spring fingers, each having a button thereon which is received within a complementary hole in the front end, whereby to remove the collar, one has only to depress the buttons.

The flashlight is provided with a U-shaped hollow handle 16 on whose upper side is mounted a slide actuator 17 that is slidable from a forward "on" position to a rear "off" position. The flashlight includes a battery compartment to receive cells 18 and 19 in series to supply power to bulb 14.

Mounted on the front end of handle 16 is a magnetic compass 20, while pivotally mounted on the rear end of the handle is a whistle 21 which can be swung out and blown by the user. Thus the user on a field trip not only has a flashlight available but also a compass to find his way, and a whistle to attract attention should this be necessary. Also included in the casing below the battery compartment is a secret compartment SC provided with a slidable access door $SC_d$. This compartment can be used to store keys or other small items that a child using the flashlight is likely to misplace.

Included in the flashlight is a delayed action switch provided with electrically-conductive springs A, B and C. These springs are mounted one above the other on a common insulating post 22, the springs being normally separated, as shown in FIG. 2. Leaf spring A forms the first contact, and leave spring B forms the second contact of the switch. Leaf spring C, which is interposed between contacts A and B, forms an intermediate contact. The switch is closed to connect the battery supply to the bulb only when both the first and second contacts A and B are in engagement with intermediate contact C, for only then is the power circuit completed. If either contact A or B is disengaged from intermediate contact C, the switch is then open.

At the underside of handle 16 is a depressible trigger lever 23 which is pivoted at its rear end at point 23P. The lever is provided with a downwardly-inclined, flat leading section 24 which cooperates with a suction cup 25. Cup 25 is fixedly mounted within the front end of the handle at a position underlying compass 20. Leaf spring contact A acts to downwardly bias trigger lever 23 to normally maintain it in its undepressed state.

When trigger lever 23 is momentarily depressed by an operator, then its leading section 24, as shown in FIG. 4, engages and compresses suction cup 25, and in doing so, collapses the cup to expel most of the air. This collapse creates a partial vacuum which acts to hold section 25 of trigger lever 23 onto the rim of cup 25. Thus, as shown in FIG. 5, when the operator releases trigger lever 23, it remains in its depressed state.

Cup 25 is formed of a resilient, synthetic elasomeric material, such as neoprene, whose memory characteristics are such that after a predetermined interval (i.e., 30 seconds), the force of the partial vacuum is overcome and the cup proceeds to resume its original cup shape. Air is then drawn into the cup and the leading section 24 of trigger lever 23 is released from the cup.

FIG. 6 illustrates the first phase of trigger lever operation, where it will be seen that the suction cup 25 is compressed and collapsed by the leading section 24 of the lever, the lever being then held by the cup in its depressed state. FIG. 7 shows the second phase in which the suction cup is in the process of resuming its normal form, but the leading section 24 of the lever is still in engagement with the cup. The final phase is shown in FIG. 8, where it will be seen that the suction cup has assumed its normal, uncompressed form, and leading section 24 of the lever is disengaged therefrom, so that the lever is now in its undepressed state.

Suction cup 25, as best seen in FIGS. 6, 7 and 8, is provided at its exact center with a small dimple 25D which acts, no matter how hard the trigger lever is pulled, to provide a partial air space between the collapsed suction cup and the leading section 254. In the absence of this minor air space, the resultant vacuum would unduly delay the automatic re-opening of the switch.

When trigger lever 23 is in its depressed state, first contact A is deflected to engage intermediate contact C. But as pointed out previously, this action is not sufficient to close the switch, for the switch is closed only when contact B also engages the intermediate contact. When trigger lever 23 is in its undepressed state, contact A is disengaged from intermediate contact C, and even if contact B is then in engagement with intermediate contact C, the switch remains open.

Contact B acts to upwardly bias slide actuator 17, this leaf spring having a bent end which is adjacent a rear cam section 17A, such that when the actuator is in its rear "off" position, as shown in FIG. 2, this contact B is disengaged from intermediate contact C. But when the actuator is pushed to its forward "on" position, as shown in FIG. 3, contact B is deflected by cam section 17A to engage intermediate contact C.

In order for the flashlight to be turned "on," it is not sufficient for the operator, who grasps the handle with his fingers, to push slide actuator 17 to its "on" position, for this only results in deflecting contact B to engage contact C, as shown in FIG. 3. It is also necessary while the slide actuator is in its "on" position for the operator to depress with his fingers, as shown in FIG. 4, trigger lever 23, and in doing so to deflect contact A so that it engages intermediate contact C. When intermediate contact C is engaged by both contacts A and B, only then will the flashlight be turned "on" for a period determined by the memory of suction cup 25.

The circuit arrangement of the switch is shown in FIG. 9, where it will be seen that battery 18 in series with battery 19 is connected to light bulb 14 only when slide actuator 17 is in its "on" position to deflect the second contact B to engage intermediate contact C and trigger lever 23 is depressed to deflect the first contact A into engagement with intermediate contact C, in which condition the switch is closed to turn on the light.

During the interval in which the flashlight is "on," the operator can, by manipulating the slide actuator repeatedly from its forward to its rear position, can produce an intermittent signalling light to attract attention. But the flashlight cannot be left on beyond the delay interval, for it automatically turns off. And in order to be turned on, the slide actuator must be in its forward or "on" position to render the switch operative, and the trigger lever must be squeezed.

Attached to each side casing 10 of the flashlight are strips L of the type used on bicycles which have a multifaceted, prismatic reflective surface or a phosphorescent surface to render the flashlight visible at night when it is turned off. This makes it possible to locate the flashlight in the dark, should it have been misplaced.

While there has been shown and described a preferred embodiment of a delayed action flashlight in accordance with the invention, it will be appreciated that many changes and modifications may be made therein without, however, departing from the essential spirit thereof.

I claim:

1. A flashlight provided with a casing housing a battery supply and a light bulb, and having a U-shaped handle graspable by an operator to direct a light beam projected from the bulb, said flashlight incorporating a delayed action switch assembly adapted to connect said supply to said bulb for a predetermined interval, at the conclusion of which the flashlight is automatically turned off, said assembly comprising:

(a) a pivoted trigger lever mounted on the underside of the handle, said lever having a flat leading section;

(b) a suction cup having memory characteristics, and means mounting the cup fixedly within the casing at a position at which it is engaged by the flat leading section when the lever is momentarily depressed, said cup being then compressed and collapsed by the flat leading section to retain the lever in a depressed state for a predetermined interval determined by the memory characteristics of the cup, at the conclusion of which the cup resumes its normal form and the lever is released; and (c) switch means cooperating with said lever operative to connect said supply to said bulb only when said lever is in the depressed state.

2. A flashlight as set forth in claim 1, wherein said handle is hollow and said lever, when depressed, is received therein.

3. A flashlight as set forth in claim 1, wherein said switch means is constituted by three stacked normally separated leaf springs supported to provide first and second contacts and an intermediate contact interposed between the first and second contacts, the first contact acting to bias the lever to maintain it in an undepressed state whereby when the lever is depressed by the operator, said first contact is deflected to engage the intermediate contact which when engaged by the second contact acts to connect the supply to the bulb.

4. A flashlight as set forth in claim 3, further including a slide actuator mounted on the upper end of the handle, the actuator being biased by said second contact and being shiftable from an "off" to an "on" position, the actuator in the "on" position deflecting said second contact to engage the intermediate contact, whereby said flashlight is turned "on" only when the lever is depressed and the actuator at the same time occupies its "on" position.

5. A flashlight a set forth in claim 1, further including a compass set into the front end of the handle.

6. A flashlight a set forth in claim 1, further including a whistle pivotally mounted on the reaar end of the handle and swingable from an inactive position in which it is nested in the handle to an active position in which it is extended therefrom.

7. A flashlight as set forth in claim 1, wherein said suction cup has a dimple at its center to provide a partial air space when the cup is compressed and collapsed.

8. A flashlight as set forth in claim 1, wherein said casing includes a compartment having a slide door for containing small objects.

9. A flashlight as set forth in claim 1, wherein said casing is provided on its exterior with reflective safety labels.

* * * * *